United States Patent [19]

Johnson et al.

[11] Patent Number: 4,758,488

[45] Date of Patent: Jul. 19, 1988

[54] STABILIZED POLYSILYLENES AND IMAGING MEMBERS THEREWITH

[75] Inventors: Gordon E. Johnson, Webster; Milan Stolka, Fairport; Ronald J. Weagley, Penfield; Frederick J. Roberts, Jr., Webster; Santokh S. Badesha, Pittsford, all of N.Y.

[73] Assignee: Xerox Corporation, Stamford, Conn.

[21] Appl. No.: 88,366

[22] Filed: Aug. 24, 1987

[51] Int. Cl.[4] ..... G03G 5/14

[52] U.S. Cl. ..... 430/59; 430/58; 430/126

[58] Field of Search ..... 430/58, 59, 126

[56] References Cited

U.S. PATENT DOCUMENTS

| | | | |
|---|---|---|---|
| 4,172,933 | 10/1979 | Turner | 526/244 |
| 4,464,460 | 8/1984 | Hiraoka et al. | 430/323 |
| 4,587,205 | 5/1986 | Harrah et al. | 430/326 |
| 4,588,666 | 5/1986 | Stolka et al. | 430/59 |
| 4,588,801 | 5/1986 | Harrah et al. | 428/33 |
| 4,618,551 | 10/1986 | Stolka et al. | 430/58 |

*Primary Examiner*—Roland E. Martin

*Attorney, Agent, or Firm*—E. O. Palazzo

[57] ABSTRACT

A photoresponsive imaging member comprised of a supporting substrate, a photogenerating layer, and a hole transporting layer comprised of a polysilylene stabilized with a component possessing an ionization potential equal to or greater than the polysilylene.

27 Claims, 1 Drawing Sheet

STABILIZED POLYSILYLENES AND IMAGING MEMBERS THEREWITH

BACKGROUND OF THE INVENTION

This invention is directed generally to stabilized polysilylenes, and more specifically to processes for the photostabilization of polysilylene polymers by utilization of stabilizer additive components. More specifically, in one embodiment the present invention is directed to the incorporation of stabilizers into polysilylenes, particularly UV stabilizers for the primary purpose of preventing degradation of the polysilylene upon exposure to light, and the selection of the resulting stabilized material in a layered photoresponsive imaging members. The aforementioned members in one particular aspect of the present invention are comprised of a supporting substrate, a photogenerating layer, and in contact therewith, a hole transport layer comprised of a stabilized polysilylene, especially poly(methylphenyl silylene), poly(n-propyl methyl silylene), and other similar silylenes. Additionally, the layer with the stabilized polysilylene hole transporting compound can be located as the top layer of the imaging member, or alternatively it may be situated between the supporting substrate and the photogenerating layer. In addition, the aforementioned members are particularly useful in electrophotographic, and especially xerographic imaging processes including those wherein there are selected for development liquid ink compositions.

Imaging members comprised of polysilylenes are illustrated in U.S. Pat. No. 4,618,551, the disclosure of which is totally incorporated herein be reference. More specifically, there is illustrated in this patent a polysilylene hole transporting compound for use in layered imaging members comprised of the formula as recited in claim 1, for example. More specifically, there is described in the aforementioned patent an improved layered photoresponsive imaging member comprised of a supporting substrate, a photogenerating layer, and as a hole transport layer in contact therewith, a polysilylene compound of the formula

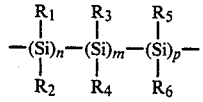

wherein $R_1$, $R_2$, $R_3$, $R_4$, $R_5$and $R_6$ are independently selected from the group consisting of alkyl, aryl, substituted alkyl, substituted aryl, and alkoxy; and m, n, and p are numbers that reflect the percentage of the particular monomer unit in the total polymer compound. Preferred polysilylene hole transporting compounds illustrated in this patent include poly(methylphenyl silylenes), which silylenes more preferably have a weight average molecular weight of in excess of 50,000, and preferably are of a weight average molecular weight of about 75,000 to about 1,000,000. The aformentioned polysilylenes can be prepared by known methods, reference the Journal of Organometallic Chemistry, page 198, C27, (1980), R. E. Trujillo, the disclosure of which it totally incorporated herein by reference. Also, other polysilylenes can be prepared as described in the Journal of Polymer Science, Polymer Chemistry Edition, Vol. 22, pages 225 to 238, (1984), John Wiley and Sons, Inc., the disclosure of which is totally incorporated herein by reference. More specifically, the aforementioned polysilylenes can be prepared as disclosed in this article by the condensation of a dichloromethyl phenyl silane with an alkali metal such as sodium. In one preparation sequence, there is reacted a dichloromethyl phenyl silane in an amount of from about 0.1 mole with sodium metal in the presence of 200 milliliters of solvent, and wherein the reaction is accomplished at a temperature of from about 100° C. to about 140° C. There results, as identified by elemental analysis, infrared spectroscopy, UV spectroscopy, and nuclear magnetic resonance, the polysilylene products subsequent to the separation thereof from the reaction mixture.

When selecting components for photoreceptors, particularly photogenerating or hole transport substances, it is important that when the member is exposed to light that it retain its stability; and more specifically, that the components thereof are not adversely effected by light causing them to degrade or decompose and thereby rendering them substantially useless for their intended purposes. In addition, during the corona charging step in electrostatic imaging processes, the voltages emitted may cause degradation of the components in the imaging member affecting the undesirable degradation thereof, and permitting emission of products, and in some instances, hazardous products to the environment. The aforementioned polysilylenes may, after some usage, degrade upon exposure to light, or may emit undesirable products subsequent to the corona charging step causing both changes in the electrical, that is transporting properties of the polysilylenes, and the mechanical characteristics thereof thereby rendering them substantially unsuitable in some instances for untilization in electrostatographic photoreceptors. Accordingly, there is a need for processes that will permit the stabilization of the aforementioned polysilylenes to enable their incorporation into photoconductive imaging members thereby preventing degradation thereof, and enabling the resulting members to be useful for extended time periods exceeding, for example, 1,000,000 imaging cycles without degradation. This is accomplished in accordance with the present invention by affecting stabilization of the polysilylenes.

Prior art patents of background interest which teach the degradation of polysilylenes by ultraviolet light include, for example, U.S. Pat. Nos. 4,464,460; 4,587,205; and 4,588,801. Also of interest is U.S. Pat. No. 4,172,933, which illustrates the introduction of an active compound into a transport polymer as a pendant moiety, reference columns 3 and 4 thereof.

SUMMARY OF THE INVENTION

It is an object of the present invention to provide stabilized polysilylenes.

It is another object of the present invention to provide stabilized polysilylenes useful as hole transporting substances in layered photoresponsive imaging members.

Moreover, in a further object of the present invention there are provided polysilylenes that are free of degradation upon exposure to light, and do not emit undesirable byproducts subsequent to being subjected to corona charging processes in electrostatographic imaging apparatuses.

Another object of the present invention resides in the incorporation of stabilizers as pendant groups chemically bonded to the polysilylene polymer backbone, which stabilizer can be incorporated at the chain ends or in the polymer chain itself.

In addition, another object of the present invention resides in the adding of components to polysilylenes for the purpose of achieving stabilization thereof.

In yet another object of the present invention there are provided layered imaging members comprised of a photogenerating pigment and a hole transporting polysilylene having incorporated therein ultraviolet light stabilizers thereby preventing degradation thereof, and enabling the selection of the polysilylene component for an extended number of imaging cycles.

Another object of the present invention resides in imaging members with stabilized hole transporting polysilylenes with improved electrical stability, and wherein the electronic transport properties thereof are substantially enhanced.

These and other objects of the present invention are accomplished by the provision of stabilized polysilylenes. More specifically, there are provided in accordance with the present invention stabilized polysilylenes of the formula

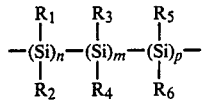

where $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that reflect the percentage of the particular monomer unit in the total polymer composition with the sum of n plus m plus p being equal to 100 percent. Specifically thus, for example, zero percent is less than, or equal to n, and n is less than or equal to 100 percent; and zero percent is less than, or equal to m, and m is less than, or equal to 100 percent; and zero is less than, or equal to p, and p is less than, or equal to 100 percent. Any of the monomer units of the polysilylene can be randomly distributed throughout the polymer, or may alternatively be in blocks of varying lengths.

Stabilization is affected by adding or incorporating as a pendant group chemically bonded to the aforementioned polysilylene polymer backbone various stabilizer components. Specifically, thus this stabilization can be accomplished by reacting the aforementioned polysilylenes wherein at least one of the R substituents is a labile hydrogen and this substituent is functionalized with various groups inclusive of hydroxy, halogen, and the like with a stabilizer or stabilizer derivative thereby providing a polysilylene with an energy acceptor substance. More specifically, the resulting polysilylene with the energy acceptor substituent absorbs the light illumination and prevents degradation of the polysilylene.

With further respect to the stabilization of the polysilylenes illustrated herein, such stabilization is accomplished with an additive which generally has an ionization potential equal to or in excess of the polysilylene, that is for example an ionization potential of from about 7 to about 10 electron volts; and further, wherein the additive absorption spectrum overlaps the fluorescence spectrum of the polysilylene. Accordingly, generally the additive should absorb light in the range of from about 320 to about 370 nanometers. Although it is not desired to be limited by theory, it is believed that the transfer of electronic energy from the polysilylene chain to the dopant molecule is occurring upon exposure to ultraviolet light whereby the energy is emitted as fluorescence, and it is in this manner that the excitation initially on the polymer chain is transferred to the additive prior to the photochemical degradation. Moreover, the stabilizer additive can be simply added as a dopant to the polyorganosilylene.

Examples of stabilizer additives that may be added or incorporated into the polysilylenes illustrated herein, which additives are preferably present in an amount of from about 2 percent to about 6 percent by weight, include aromatic hydrocarbons such as anthracene, 9,10-diphenyl antracene, fluoranthene, chrysene, 4,5-dimethyl chrysene, p-quaterphenyl, benzanthrene, and the like; organic scintillators such as 2,5-diphenyloxazole, 1,4-bis[2-(5-phenyloxazole)]benzene, 2-(4-biphenyl)-6-phenylbenzoxazole, (2-(4-biphenyl)-5-phenyl-1,3,4-oxadiazole, and the like; and laser dyes such as Coumarin-1, which is 7-diethylamino-4-methylcoumarin, 7-hydroxy-4-methylcoumarin, 7-diethylamino-4-methylcoumarin, and the like. As indicated herein, the aforementioned stabilizer can be added as a dopant and/or may be incorporated into the polyorgano silylene as a group pendant to the polymer backbone. Additionally, the stabilizer may be incorporated into the polymer backbone. When the stabilizer is incorporated as a pendant group or along the backbone of the polysilylene, it usually contains a reactive substituent such as a vinyl component thereby allowing the stabilizer to react with the growing polymer chain or with the functional group pendant to the chain backbone.

Other stabilizers can be utilized providing the objectives of the present invention are achievable including aryl amines as illustrated in U.S. Pat. No. 4,295,990, the disclosure of which is totally incorporated herein by reference, such as N,N'-diphenyl-N,N'-bis(3-methylphenyl)-[1,1-phenyl-biphenyl]-4,4'-diamine, tetraphenyl benzidine, tetra(p-tolyl)benzidine, terphenyl and quaterphenyl analogs of N,N'-diphenyl-N,N'-bis(3-methylphenyl)-[1,1-phenyl-biphenyl]-4,4'-diamine, and the like.

With the aforementioned stabilized polysilylenes, there is enabled the advantages as illustrated herein and other advantages inclusive of, for example, the substantial prevention of cracking of the imaging member within which the stabilized polysilylene is incorporated. It is known that cracking can render the aforementioned imaging members substantially inoperable in that electrostatic latent images cannot be formulated thereon, especially when the cracking is severe. In addition, the photoresponsive imaging member softens subsequent to degradation of the polysilylene rendering the member tacky and causing it to adversely effect the charge transporting characteristics of the hole transport layer, and eventually preventing the formation and development of electrostatic latent images thereon.

Subsequent to stabilization, the polysilylenes resulting are particularly useful as hole transporting components in layered photoresponsive imaging members as illustrated in U.S. Pat. No. 4,618,551, the disclosure of which has been previously totally incorporated herein by reference. Thus, in one specific embodiment of the present invention there is provided an improved photoresponsive imaging member comprised of a supporting substrate, a photogenerating layer comprised of inorganic photoconductive pigments optionally dispersed in an inactive resinous binder, and as a top layer functioning as a transporting component the aforementioned stabilized polysilylenes. Another specific photoresponsive imaging member of the present invention is comprised of the stabilized polysilylene hole transporting component layer situated between the supporting substrate and the photogenerating layer.

With further respect to the stabilized polysilylenes of the present invention, examples of alkyl groups include those that are linear, or branched of from one carbon atom to about 24 carbon atoms, and preferably from about 1 carbon atom to about 8 carbon atoms, inclusive of methyl, ethyl, propyl, butyl, amyl, hexyl, octyl, nonyl, decyl, pentadecyl, stearyl; and unsaturated alkyls inclusive of alyls, and other similar substitutents. Specific preferred alkyl groups are methyl, ethyl, propyl and butyl. Aryl substituents include those of from 6 carbon atoms to about 24 carbon atoms, inclusive of phenyl, naphthyl, anthryl, and the like. These alkyl and aryl groups may be substituted with alkyl, aryl, halogen, nitro, amino, alkoxy, cyano, and other related substituents. Examples of alkoxy groups include those with from 1 carbon atom to about 10 carbon atoms, such as methoxy, ethoxy, propoxy, butoxy, and other similar substitutents.

Illustrative specific examples of polysilylene hole transporting compounds that may be stabilized in accordance with the process of the present invention include poly(methylphenyl silylene), poly(methylphenyl silylene-co-dimethyl silylene), poly(cyclohexylmethyl silylene), poly(tertiary-butylmethyl silylene), poly(-phenylethyl silylene), poly(n-propylmethyl silylene), poly(p-tolylmethyl silylene), poly(cyclotrimethylene silylene), poly(cyclotetramethylene silylene), poly(cyclopentamethylene silylene), poly(di-t-butyl silylene-co-di-methyl silylene), poly(diphenyl silylene-co-phenylmethyl silylene), poly(cyanoethylmethyl silylene), and poly(phenylmethyl silylene), about 96 percent with about 4 percent by weight of a dispersed aryl amine, especially N,N'-bis(3-methyl phenyl)-1,1'-biphenyl-4,4'-diamine stabilizing component.

The improved photoresponsive imaging members of the present invention can be prepared by a number of known methods, the process parameters, and the order of the coating of the layers being dependent on the member desired. Thus, for example, the improved photoresponsive members of the present invention can be prepared by providing a conductive substrate with an optional hole blocking layer, and optional adhesive layer; and applying thereto by solvent coating processes, laminating processes, or other methods, a photogenerating layer and the stabilized polysilylene hole transport layer. Other methods include melt extrusion, dip coating, and spraying.

BRIEF DESCRIPTION OF THE DRAWINGS

For a better understanding of the present invention and further features thereof, reference is made to the following detailed description of various embodiments wherein.

As overcoatings for these members, there can be selected an aryl amine dispersed in a resin binder, inclusive of polycarbonates containing carbon black. The carbon black is usually present in various amounts, however, from about 5 percent to about 15 percent of carbon black is preferred.

DESCRIPTION OF THE PREFERRED EMBODIMENTS

Figure 1:
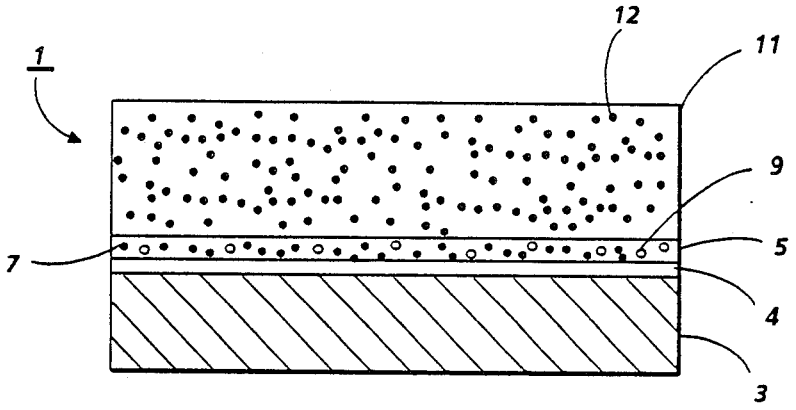
FIG. 1 is a partially schematic cross-sectional view of a photoresponsive imaging member of the present invention.

Illustrated in FIG. 1 is a negatively charged improved photoresponsive imaging member of the present invention generally designated 1, and comprising a supporting substrate 3, an optional adhesive blocking layer 4, a charge carrier photogenerating layer 5 comprised of a photogenerating pigment 7, optionally dispersed in inactive resinous binder composition 9, and hole transport layer 11 comprised of 12, a polysilylene hole transporting compound stabilized with the additives illustrated herein, such as aryl amines, In an alternative embodiment of the present invention, and with further regard to FIG. 1, the hole transporting layer can be situated between the supporting substrate and the photogenerating layer resulting in a positively charge imaging member.

Figure 2:
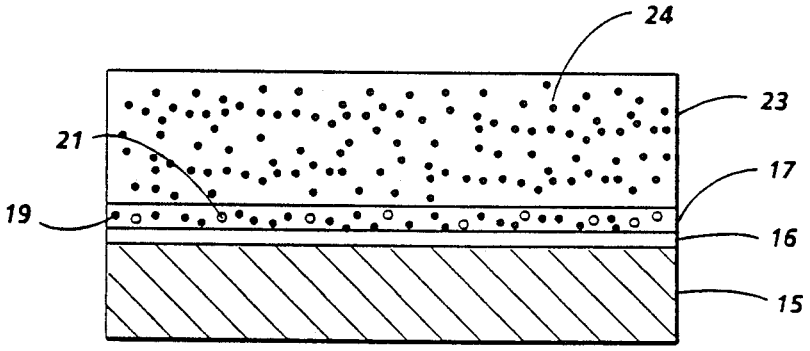
FIG. 2 represents a partially schematic cross-sectional view of a photoresponsive imaging member of the present invention.

Illustrated in FIG. 2 is a negatively charged photoresponsive imaging member of the present invention comprised of a conductive supporting substrate 15 of aluminized Mylar, an optional adhesive blocking layer 16, a photogenerating layer 17 comprised of a trigonal selenium photogenerating pigment 19; or other similar inorganic pigments as well as organic pigments dispersed in a resinous binder 21, and a hole transport layer 23 comprised of a poly(methylphenyl silylene) 24 stabilized with the additives illustrated herein.

Other imaging members similar to those as presented in FIGS. 1 and 2 are included within the scope of the present invention such as those wherein, for example, protective overcoating layers can be utilized.

With further respect to the imaging members of the present invention, the supporting substrate layers may be opaque or substantially transparent, and may comprise any suitable material having the requisite mechanical properties. Thus, these substrates may comprise a layer of nonconducting material such as an inorganic or organic polymeric material, a layer of an organic or inorganic material having a conductive surface layer arranged thereon or a conductive material such as, for example, aluminum, chromium, nickel, indium, tin oxide, brass or the like. The substrate may be flexible or rigid and may have any of many different configurations such as, for example, a plate, a cylindrical drum, a scroll, an endless flexible belt and the like. Preferably, the substrate is in the form of an endless flexible belt. The thickness of the substrate layer depends on many factors including economical considerations. Thus, this layer may be of substantial thickness, for example, over 100 mils or minimum thickness providing there are no adverse effects on the system. In one preferred embodiment, the thickness of this layer ranges from about 3 mils to about 10 mils.

Examples of pigments for the photogenerating layer are as illustrated, for example, in U.S. Pat. No. 4,618,551, the disclosure of which is totally incorporated herein by reference, inclusive of amorphous selenium, selenium alloys such as $As_2Se_3$, trigonal selenium, metal free phthalocyanines, metal phthalocyanines, vanadyl phthalocyanines, squaraines, and the like, with $As_2Se_3$ being preferred. Typically, this layer is of a thickness of from about 0.3 micron to about 10 microns or more; however, dependent on the photoconductive volume loading which may vary from 5 to 100 volume percent, this layer can be of other thicknesses, such as from about 0.5 to about 3 microns. Generally, it is desirable to provide this layer in a thickness which is sufficient to absorb about 90 percent or more of the incident radiation, which is directed upon it in the imagewise exposure step. The maximum thickness of this layer is dependent primarily upon facts such as mechanical considerations, for example whether a flexible photoresponsive imaging member is desired. Optional resin binders selected for the photogenerating pigments or in some instances for the hole transport layer include, for example, the polymers as illustrated in U.S. Pat. No. 3,121,006, the disclosure of which is totally incorporated herein by reference; polyesters, polyvinyl butyrals, polyvinyl carbazoles, polycarbonate resins, epoxy resins, polyhydroxyether resins, and the like.

The stabilized polysilylenes of the present invention are also useful as protective overcoating materials for various photoreceptor members including amorphous selenium, selenium alloys, hydrogenated amorphous silicon, layered members containing selenium arsenic alloys as the top layer, reference U.S. Ser. No. 487,935 entitled Overcoated Photoresponsive Devices, the disclosure of which it totally incorporated herein by reference; and layered imaging members comprised of a photogenerating layer, and a diamine hole transport layer, reference U.S. Pat. No. 4,265,990 referred to hereinbefore. In this embodiment, the polysilylenes are applied as an overcoating to the imaging member in a thickness of from about 0.5 micron to about 7.0 microns, and preferably from about 1.0 micron to about 4.0 microns. Moreover, the stabilized polysilylene compositions of the present invention can be selected as resinous binders for the imaging members described herein, including binders for inorganic and organic photogenerators such as trigonal selenium, selenium alloys, hydrogenated amorphous silicon, silicon-germanium alloys, and vanadyl phthalocyanine. In this embodiment, for example, the imaging member is comprised of a supporting substrate, a photogenerating layer comprised of a photogenerating pigment of trigonal selenium, or vanadyl phthalocyanine dispersed in the stabilized polysilylene compositions, which are now functioning as a resinous binder; and as a top layer an aryl amine hole transport composition, reference the '990 patent mentioned herein, or polysilylenes.

Further, the polysilylene compositions of the present invention may also function as interface layers. As interface layers the polysilylenes are applied between, for example, a supporting substrate and the photogenerating layer, or the photogenerating layer and the hole transport layer, enabling improved attachment of the respective layers. Also, there can be included in the imaging members illustrated herein adhesive layers such as polyester resins available as Ditel PH-100, Ditel PH-200, and Ditel PH-222, all available from Goodyear Tire and Rubber Company; polyvinyl butyral; DuPont 49,000 polyester; and the like. The aforementioned adhesive layer is generally of a thickness of from about 200 micrometers to about 900 micrometers, and is applied from a solvent solution of, for example, tetrahydrofuran toluene and methylene chloride. This adhesive layer can be situated on the supporting substrate or may be situated between an optional hole blocking layer and the supporting substrate. Examples of blocking layers include siloxanes as illustrated in U.S. Pat. No. 4,464,450, the disclosure of which is totally incorporated herein by reference. Other blocking layers include the silylenes as illustrated in U.S. Pat. Nos. 4,338,387; 4,286,033; and 4,291,110, the disclosures of which are totally incorporation herein by reference, including (gamma-amino propyl)methyl diethoxy silylenes.

The imaging members of the present invention are useful in various electrophotographic imagic systems, especially xerographic systems, wherein an electrostatic image is formed on the photoresponsive imaging member, followed by the development thereof, transfer to a suitable substrate, and fixing of the resultant image.

With further respect to the aforementioned imaging processes, the stabilized polysilylenes do not degrade upon exposure to imaging light, nor are undesirable byproducts emitted subsequent to corona charging in a xerographic imaging process thereby preventing the electrical properties and mechanical characteristics of the resulting imaging member to remain stable for an extended number of imaging cycles exceeding 1,000,000, for example.

The invention will now be described in detail with respect to specific preferred embodiments thereof, it being understood that these examples are intended to be illustrative only. The invention is not intended to be limited to the materials, conditions, process parameters, etc. recited herein. All parts and percentages are by weight unless otherwise indicated.

EXAMPLE I

There was prepared a stabilized poly(methylphenyl silylene) by formulating a solution containing 0.2 weight percent of the aforementioned polysilylene with a weight average molecular weight in excess of 50,000, which solution contained about 200 milligrams of polymer per 10 milliliters of benzene; and there was subsequently added to the solution 4.62 weight percent of 9,10-diphenyl-anthracene. Thereafter, a film was formulated by depositing the aforementioned solution on a supporting substrate, which film had a thickness of 0.1 micron. This film was then subjected to ultraviolet light emitting energy in a wavelength region of 320 to 370 nanometers, and no degradation of the film resulted after 5 minutes. More specifically, by physical observations subsequent to the 5 minute period no cracking of the film was observed.

For hole transporting layers there were prepared similar films with the exception that there was selected about 5 percent by weight of the polysilylene polymer thereby resulting in a transporting layer with a thickness of about 20 microns.

EXAMPLE II

A photoresponsive imaging member was then prepared by providing an aluminized Mylar substrate in a thickness of three mils, followed by applying thereto with a multiple clearance film applicator in a wet thickness of 0.5 micron, a layer of 3-aminopropyl triethoxy silane, available from PCR Research Chemicals of Florida, and ethanol in a 1:50 volume ratio. This layer was then allowed to dry for 5 minutes at room temperature, followed by curing for 10 minutes at 110° C. in a forced air oven. A photogenerating layer of amorphous selenium in a thickness of 0.4 micron was then applied to the silane layer. Thereafter, the amorphous selenium photogenerating layer was overcoated with the stabilized poly(methylphenyl silylene) transport layer of Example I prepared above from a solution of toluene and tetrahydrofuran, volume ratio of 2:1, this deposition being affected by spraying. There resulted after drying a charge transport layer of 20 microns in thickness.

Electrostatic latent images can be generated in the aboveprepared imaging member by incorporation thereof into a xerographic imaging test fixture, and after charging the member to a negative voltage of about 1,000 volts. Thereafter, the resulting images can be developed with a toner composition comprised of 90 percent by weight of a styrene n-butylmethacrylate copolymer (58/42), 8 percent by weight of carbon black particles, and 2 percent by weight of the charge enhancing additive cetyl pyridinium chloride. The aforementioned imaging member would be useful for in excess of 500,000 imaging cycles, and wherein no cracking of the members should occur in view of the stabilization of the poly(methylphenyl silylene) hole transporting component.

Other imaging members can be prepared by repeating the above procedure, reference for example U.S. Pat. No. 4,618,551, the disclosure of which has been totally incorporated herein by reference.

Although the invention has been described with reference to specific preferred embodiments, it is not intended to be limited thereto; rather, those skilled in the art will recognize variations, and modifications may be made therein which are within the spirit of the invention and within the scope of the following claims.

What is claimed is:

1. A photoresponsive imaging member comprised of a supporting substrate, a photogenerating layer, and a hole transporting layer comprised of a polysilylene stabilized with a component possessing an ionization potential equal to or greater than the polysilylene and an additive absorption spectrum which overlaps the fluorescence spectrum of the polysilylene.

2. An imaging member in accordance with claim 1 wherein the polysilylene is of the formula

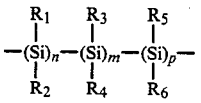

wherein $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that reflect the percentage of the particular monomer unit in the total polymer compound.

3. An imaging member in accordance with claim 1 wherein the polysilylene is poly(methylphenyl silylene).

4. An imaging member in accordance with claim 1 wherein the polysilylene is poly(n-propylmethyl silylene)-co-methylphenyl silylene.

5. An imaging member in accordance with claim 1 wherein the polysilylene is poly(n-propylmethyl silylene).

6. An imaging member in accordance with claim 1 wherein there is selected a stabilizing component selected from the group consisting of aromatic hydrocarbons, organic scintillators, and laser dyes.

7. An imaging member in accordance with claim 6 wherein the stabilizer is present in an amount of from about 2 percent by weight to about 6 percent by weight.

8. An imaging member in accordance with claim 6 wherein the aromatic hydrocarbon stabilizer is selected from the group consisting of anthracene, 9,10-diphenyl anthracene, fluoranthene, chrysene, 4,5-dimethyl chrysene, p-quaterphenyl, and benzanthrene.

9. An imaging member in accordance with claim 6 wherein the organic scintillator stabilizer is 2,5-diphenyloxazole, 1,4-bis[2-(5-phenyloxazole)]benzene, 2-(4-biphenyl)-6-phenylbenzoxazole, or 2-(4-biphenyl)-5-phenyl-1,3,4-oxadiazole.

10. An imaging member in accordance with claim 1 wherein the stabilizer is 9,10-diphenyl anthracene.

11. An imaging member in accordance with claim 1 wherein the stabilizer is an aryl amine.

12. An imaging member in accordance with claim 11 wherein the aryl amine is selected from the group consisting of N,N'-diphenyl-N,N'-bis(3-methylphenyl)-[1,1-phenyl-biphenyl]-4,4'-diamine, tetraphenyl benzidine, and tetra(p-tolyl)benzidine.

13. An imaging member in accordance with claim 1 wherein the ionization potential of the stabilizer component is from about 7 to about 10 electron volts.

14. An imaging member in accordance with claim 1 wherein the stabilizer component absorbs light in the wavelength region of from about 320 to about 370 nanometers.

15. An imaging member in accordance with claim 1 wherein the stabilizer is incorporated into the polysilylene backbone.

16. An imaging member in accordance with claim 1 wherein the photogenerating layer is comprised of photogenerating pigments selected from the group consisting of inorganic photoconductive pigments, and organic photoconductive pigments.

17. An imaging member in accordance with claim 16 wherein the inorganic pigments are amorphous selenium, selenium alloys, or trigonal selenium.

18. An imaging member in accordance with claim 1 wherein there is further included thereover a protective overcoating.

19. An imaging member in accordance with claim 2 wherein there if further included thereover a protective overcoating.

20. An imaging member in accordance with claim 1 wherein a supporting substrate is comprised of a conductive material or a polymeric composition.

21. An imaging member in accordance with claim 1 wherein a supporting substrate is of a thickness of from about 3 mils to about 10 mils; the photogenerating layer is a thickness of from about 0.3 micron to about 10 microns; and the polysilylene hole transport layer is a thickness of from about 2 microns to about 50 microns.

22. An imaging member in accordance with claim 1 wherein the photogenerating layer is dispersed in a resinous binder.

23. An imaging member in accordance with claim 1 wherein the stabilized polysilylene is dispersed in a resinous binder.

24. A process for generating developed electrostatic latent images which comprises providing the imaging member of claim 1, and forming thereon an electrostatic latent image, thereafter accomplishing the development of this image, subsequently transferring the developed image to a suitable substrate, and affixing the image thereto.

25. A process in accordance with claim 24 wherein the imaging member resists photodegradation for 1,000,000 imaging cycles.

26. A process in accordance with claim 24 wherein the polysilylene hole transporting component retains its electrical characteristics for 500,000 imaging cycles.

27. A process in accordance with claim 24 wherein the photoresponsive imaging member retains its mechanical properties for 500,000 imaging cycles.

* * * * *